US006193436B1

(12) United States Patent
Ellis

(10) Patent No.: US 6,193,436 B1
(45) Date of Patent: Feb. 27, 2001

(54) LOCKING SYSTEM FOR SUPPORTING ELEMENT

(75) Inventor: M. Jeffrey Ellis, Spring Valley, NY (US)

(73) Assignee: Rand Display, Inc., Teaneck, NJ (US)

( * ) Notice: Subject to any disclaimer, the term of this patent is extended or adjusted under 35 U.S.C. 154(b) by 0 days.

(21) Appl. No.: 09/204,845

(22) Filed: Dec. 3, 1998

(51) Int. Cl.[7] ..... F16B 2/08

(52) U.S. Cl. ..... 403/331; 403/333; 403/398; 403/399; 248/219.4

(58) Field of Search ..... 403/331, 333, 403/334, 335, 381, 398, 399; 248/219.4, 230.7

(56) References Cited

U.S. PATENT DOCUMENTS 2,857,188 * 10/1958 De Fougerolles ..... 403/398
3,161,425 * 12/1964 Aho et al. ..... 403/398
3,166,284 * 1/1965 Blonder ..... 248/230.7
4,019,298 * 4/1977 Johnson, IV ..... 403/331 X
4,962,914 * 10/1990 Taylor ..... 403/331 X
5,244,300 * 9/1993 Perreira et al. ..... 403/333 X
5,323,584 * 6/1994 Scarlett ..... 403/381 X
5,369,902 * 12/1994 Minster ..... 248/219.4 X
5,666,713 * 9/1997 Kubota ..... 403/311 X
5,692,722 * 12/1997 Lundagards ..... 403/331 X
5,924,255 * 7/1999 Vagedes ..... 403/331 X
5,954,305 * 9/1999 Calabro ..... 248/219.4
5,961,248 * 10/1999 Tourtellotte ..... 403/385 X

* cited by examiner

*Primary Examiner*—Lynne H. Browne
*Assistant Examiner*—John R. Cottingham
(74) *Attorney, Agent, or Firm*—Mark P. Stone

(57) ABSTRACT

A locking system for supporting legs removably mounted to a tray, table or other structure to be supported includes cooperating engagement elements for removably connecting a supporting element, such as a pole or leg, to a clamp. The connected pole and clamp are removably retained, as a unit, in a retaining element extending from the structure to be supported. A stop element is provided on the clamp, the retaining element, or both, so that the clamp and the pole are retained as a single unit in a desired position within the retaining element when the locking system is assembled. The system may be readily assembled and disassembled into its individual components without employing any special tools.

13 Claims, 2 Drawing Sheets

LOCKING SYSTEM FOR SUPPORTING ELEMENT

BACKGROUND OF THE INVENTION

The present invention is directed to locking systems for supporting elements employed to support a structure in an elevated position. More specifically, the invention is directed to a locking system formed from a plurality of cooperating components which can readily be assembled into an operational position, and disassembled into the individual components without employing any special tools.

Trays, tables, and displays having removable supporting legs are known to the art. It is generally necessary to employ tools for mounting or dismounting the supporting legs to the structure being supported and elevated above the floor. For example, supporting legs are mountable to a supporting structure by mounting screws, requiring the use of screws and a screwdriver to both assemble and disassemble the overall structure.

It is the primary object of the present invention to provide a locking system for supporting legs to support a structure, such as a tray, table or display, in an elevated operational position, without requiring the use of a tool for assembling and disassembling the overall unit. Other objects and advantages of the present invention will become apparent from the following discussion.

SUMMARY OF THE INVENTION

In accordance with the present invention, a locking system is provided for assembling and disassembling supporting elements, such as supporting legs or poles, to a structure to be supported in an elevated position, as for example, a tray, a table top, or a display. The locking system includes cooperating elements on a supporting leg and clip, by which the clip is removably mountable to the supporting leg. Such cooperating structure includes a pin extending from the clip and receivable in an opening defined in the supporting leg, or the reverse structure in which a pin extends from the supporting leg and is receivable in an opening defined in the clip. The combined removably connected clip and supporting leg is itself removably retained, as a unit, in retaining means associated with the structure (such as a tray) to be supported by the supporting leg. The retaining means includes a bracket defining a channel which is adapted to slideably receive portions of the clip for retaining the clip and the supporting leg, as a unit, in the channel. The clip and supporting leg may be retained in the channel by friction fit engagement between a portion of the clip received in the channel, and the adjacent surfaces defined by the channel. The friction fit engagement can be enhanced by tapering the channel or by tapering the portion of the clip received in the channel. In the alternative, at least one stop element can be provided on a portion of the clip received in the channel, in a portion of the channel, or both, to removably retain the clip and the supporting leg, as a unit, in a predetermined desired position within the channel.

The locking system in accordance with the present invention enables supporting legs to be mounted to a supporting structure such as a tray for elevating the supporting structure, without the use of any separate tools. Similarly, the assembled unit can be disassembed into its individual components for storage or transport without the use of any tools.

DISCUSSION OF THE BEST MODES FOR CARRYING OUT THE INVENTION

Figure 1:
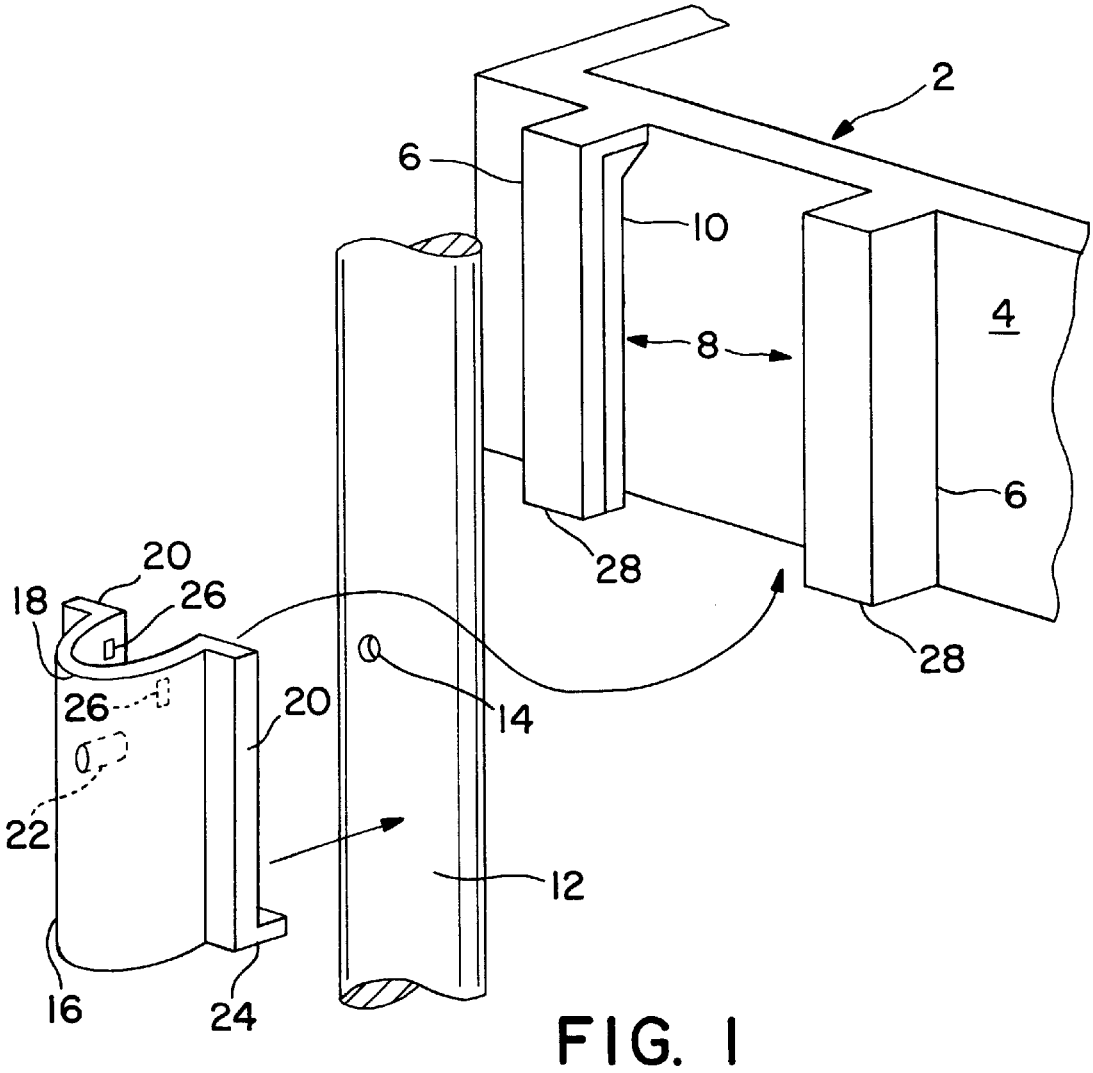
FIG. 1 schematically illustrates, in perspective, an exploded view of the components of a locking system in accordance with the present invention.

FIG. 1 of the drawing illustrates the components of a locking system in accordance with the present invention prior to assembly. A tray, table top, or other article to be supported in an elevated position is designated generally by reference numeral 2. The tray 2 includes a sidewall designated by the reference numeral 4. A bracket is defined by two elements 6 extending outwardly from the sidewall 4 of the tray, and a channel designated by reference numeral 8 is defined between the two outwardly extending elements 6. Each element 6 defines a longitudinally extending groove 10 defined in a portion of the inner surface thereof. Preferably the elements 6 are formed from a rigid but flexible plastic material.

A pole designated by reference numeral 12 provides a supporting leg for the tray when the tray is mounted to the pole in an elevated position. Preferably the pole is circular in cross sectional dimension, and defines an opening 14 in the outer surface thereof.

A clip element is generally designated by reference numeral 16. The clip 16 is formed from a generally semi-circular central portion designated by the reference numeral 18, and two substantially transverse elements 20 extending from opposed sides of the center portion 18. The central semi-circular portion 18 of the clip 16 is configured and dimensioned to substantially complement a portion of the outer surface of the pole 12. A pin, designated by the reference numeral 22, extends inwardly from the inner surface of the semi-circular portion of the clip 16. Preferably, the pin is oriented along the longitudinal center of the clip 16. In the preferred embodiment of the invention, the clip 16 is formed from a durable but flexible plastic material, and the pin 22 is formed from the same material as the clip and is integral with the clip.

The clip 16 also includes a tab element 24 extending from the bottom end of each of the side extension portions 20 of the clip. Preferably, the tabs 24 are formed from the same material as the clip 16, and are integral with the clip. The clip 16 can also include a pair of opposed bumper elements designated by reference numeral 26, disposed proximate to the remote ends of the semi-circular portion 22 of the clip.

To assemble the locking device illustrated by FIG. 1, the clip 16 is first removably mounted to the pole 14 by inserting the pin 22 into the opening 14. As noted above, the central portion 18 of the clip is configured to conform to the outer surface of the pole 12 so that the pole is snugly received in the central portion 18 when the pin 22 is inserted into the opening 14. The clip is formed from a flexible material to facilitate coupling of the clip to the pole, and the bumpers 26 tend to retain the clip on the pole when the pin is received in the opening.

Once the clip is mounted to the pole, this assembly, as a unit, is removably mounted to the tray 2. This is accomplished by positioning the clip 16 with the pole received therein beneath the channel 8 and in alignment therewith. The clip and the pole are then moved upwardly, as a unit, such that the two opposed side elements 20 extending from the clip 16 are each received respectively, in one of the grooves 10 defined in the opposed elements 6 extending from the sidewall of the tray 2. The clip and pole assembly is moved relatively upwardly in the channel 8 until the upper surface of each tab 24 of the clip abuts against the lower surface 28 of one of the longitudinally extending elements 6. The engagement of the tabs 24 with the lower surfaces 28 of the elements 6 acts as a stop and tends to support the tray 2 in its elevated position when the supporting poles 12 are mounted to the tray. The dimensions of the channel 8 and the grooves 10 are selected to conform to the dimensions of the clip 16 so that the side elements 20 are retained by friction fit engagement in the grooves 10 of the extending element 6, and the downward force of the weight of the tray 2 and pole in the desired elevated operational position. The integrity of the engagement of the clip 16 in the channel 8 is enhanced by the abutment of the tabs 24 against the lower surfaces of the elements 6, and the downward force of the weight of the tray 2 tends to maintain the tray and pole in the desired elevated operational position. Additionally, since both the extending elements 6 and the side portions 20 of the clip are preferably formed from a flexible material, the interaction of the resilient forces of these materials further serves to retain the side elements 20 of the clip in the respective grooves 10. If desired, the integrity of the friction fit engagement of the clamp in the channel can be further enhanced by either slightly tapering the side elements 20 so that they diverge outwardly in a downward direction as shown in FIG. 1, or by slightly tapering the relative orientation of the elements 6 so that they converge inwardly in a direction from bottom to top as shown in FIG. 1.

Figure 2:
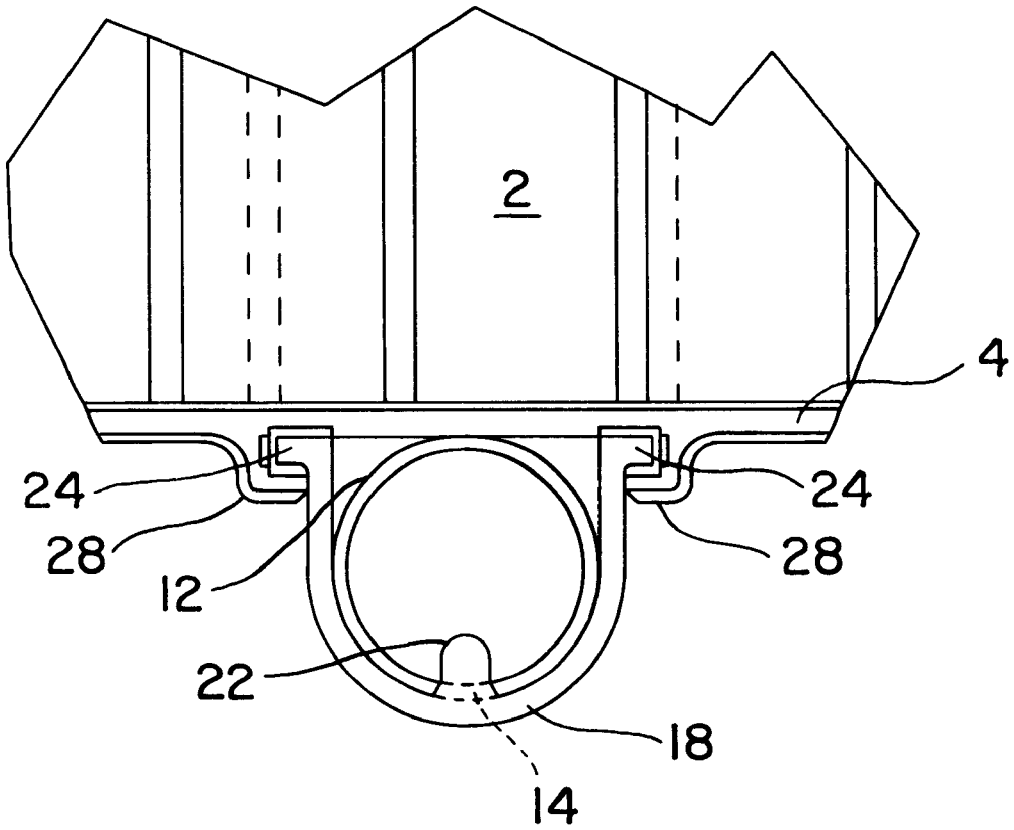
FIG. 2 illustrates a bottom plan view of the components illustrated in FIG. 1 in an assembled locking configuration in accordance with the present invention.

FIG. 2 illustrates a bottom plan view of the components illustrated by FIG. 1 when they are assembled into a locking position as described above. As shown by FIG. 2, the pole 12 is received within the semi-circular portion 18 of the clip 16, and the pin 14 extends inwardly from the semi-circular portion 18 of the clip and through the opening 14 defined in the pole. The tabs 24 of the clip abut against the respective lower ends 28 of the elements 6 extending from the sidewall 4 of the tray 2. As discussed with respect to FIG. 1, when the components are assembled in the locked configuration as illustrated by FIG. 2, the side extensions 20 of the clip 16 are firmly received within the grooves 10 defined in the opposed sides of the channel 8. The tab 24 acts as a stop element to limit movement of the clip and pole combination relative to the channel 8 so that when the tab 24 abuts against the lower ends 28 of the element 6, the clip and pole combination is oriented in a predetermined operational position relative to the tray. The tab element 24 additionally tends to support the weight of the tray, together with the pole, when the clip and pole assembly are retained in the channel 8 to support the tray and maintain it in its elevated operational position.

It is apparent from the above description that the pole 12 is readily mountable to the tray 2 to support the tray in an elevated position, without the use of any tools. Assembly of the pole to the tray is accomplished by merely removably mounting the clip 16 to the pole 12 and thereafter removably mounting the clip/pole combination, as a unit, to the retaining means for the clip operatively associated with the tray. Disassembly of the system is readily accomplished by the reverse procedure—removal of the clip/pole assembly as a unit by sliding it out of the channel 8 defined in the tray, and thereafter removing the clip from the pole.

Although FIG. 1 illustrates a pole 12 having only a single opening 14, a plurality of openings 14 can be defined in the pole for receiving a plurality of pins 22 extending from a plurality of clips 16. In this manner, separate clips are removably mountable to separate positions along the pole 12, so that a plurality of separate trays, each of which include retaining means for a clip, are removably mountable to the same pole at different positions (elevations) along the pole. In this manner, the device supports a plurality of trays stacked at different elevations. Moreover, although FIG. 1 illustrates only a single channel 8 on one sidewall 4 of the tray 2, preferably, the tray will include a sufficient number of retaining means at sufficient locations on the tray to provide stability to the tray when it is supported on a plurality of poles in its elevated operational position.

FIGS. 1 and 2 illustrate the preferred embodiment of the invention. However, modifications are within the scope of the invention. For example, in the preferred embodiment, the pin 2 extends inwardly from the central portion 18 of the clip and is received in the opening 14 defined in the pole 12. However, it is possible to reverse this arrangement such that a pin extends outwardly from the pole 12 and is received through an opening in the central portion 18 of the clip 16. The clip retaining means on the tray, formed from extending elements 6 and grooves 10, can also be modified from that shown in the drawing. Any retaining means adapted to removably receive a clip/pole combination as a unit can be employed in accordance with the present invention. Although the drawings illustrate that the grooves 10 are defined in the elements 6 which receive the side extensions 20 of the clip, this arrangement can be reversed so that extensions project from elements 6 inwardly into the channel 8 and grooves defined on the clip receive the extensions projecting into the channel. Similarly, the configuration of the clip can be modified from that shown in the drawings. Any clip adapted to be removably coupled to a pole or supporting element and thereafter adapted to be removably mounted as a unit to the structure being supported, can be employed in the present invention. Moreover, although the central portion 18 of the clip 16 is illustrated as being semi-circular in configuration to complement the circular configuration of the pole, both the configuration of the central portion of the clip and the pole can be modified from that shown in the drawing, provided that the respective configurations are complementary. Therefore, the central portion 18 of the clip can be of a square or rectangular cross section if the pole or supporting element 12 is of a corresponding cross-sectional configuration. Additionally, although the tabs 24 extend from the lower end of the sidewall extensions 20 of the clip 16, it is also within the scope of the present invention to provide the tab on the top end of the sidewall extensions of the clip, in which case the clip/pole combination will be moved in a downward direction relative to the channel 8 and the tabs will abut against the top surfaces of the elements 6. Moreover, instead of providing the tabs 24 on the clip 16 in accordance with the preferred embodiment of the invention, the tabs can alternatively be provided on either the upper or lower end of the elements 6 extending from the tray 2 so as to provide a stop for the clip and to maintain the clip/pole combination in its desired operational position relative to the tray.

Other modifications within the scope of the invention will become apparent to those skilled in the art. Accordingly, the description of the best mode of the invention herein is intended to be illustrative, and not restrictive of the scope of the invention, that scope being defined by the following claims and all equivalents thereto.

What is claimed is:

1. A system for removably locking a supporting element to an article to be supported, said system comprising:

a connecting element and means for removably connecting said connecting element to said supporting element, and retaining means operatively associated with said article to be supported, said retaining means adapted to removably receive said connecting element and said supporting element, as a unit, for removably coupling said connecting element and said supporting element, as a unit, to said article to be supported, said retaining means including a bracket extending from said article to be supported, said bracket defining a channel, said channel being adapted to removably receive said connecting element when said connecting element is removably connected to said supporting element, said bracket defining at least one groove merging with said channel, said groove adapted to removably receive a portion of said connecting element when said connecting element is removably connected to said supporting element.

2. The system as claimed in claim 1 wherein said connecting element defines a portion configured to substantially complement the configuration of said supporting element.

3. The system as claimed in claim 1 wherein said means for removably connecting said connecting element to said supporting element comprises an opening defined in one of said connecting and supporting elements, and a pin extending from the other of said connecting and supporting elements such that said pin is received in said opening when said supporting element is connected to said connecting element.

4. The system as claimed in claim 3 wherein said pin extends from said connecting element and said opening is defined in said supporting element.

5. The system as claimed in claim 2 wherein said connecting element includes an extending portion adapted to be received in said retaining means when said connecting element and said supporting element are removably mounted, as a unit, to said retaining means.

6. The system as claimed in claim 5 wherein said extending portion of said connecting element is adapted to be received in a complementary groove defined in said retaining means.

7. The system as claimed in claim 1 wherein said connecting element includes a stop element adapted to limit movement of said connecting element and said supporting element, as a unit, relative to said retaining means.

8. The system as claimed in claim 1 wherein said connecting element is formed from a flexible material.

9. The system as claimed in claim 1 wherein said retaining means is formed from a flexible material.

10. The system as claimed in claim 1 wherein the width of said channel is tapered in a predetermined direction.

11. A system for removably locking a supporting element to an article to be supported, said system comprising:

a connecting element adapted to be removably connected to said supporting element, said connecting element comprising a first central portion generally configured to correspond to the configuration of said supporting element, a second portion extending from said first central portion, and a pin projecting from said first central portion and adapted to be received in an opening in said supporting element, means operatively associated with said article to be supported for retaining said connecting element and said supporting element, as a unit, for removably coupling said connecting element and said supporting element, as a unit, to said article to be supported, and at least one tab extending from said second portion of said connecting element for engaging said means for retaining for limiting movement of said connecting element relative to said means for retaining.

12. The system as claimed in claim 11 wherein said means for retaining includes at least one groove for removably receiving therein said second portion of said connecting element.

13. The system as claimed in claim 11 wherein said means for retaining comprises a channel defined between two opposed elements extending from said article to be supported.

* * * * *